US006248047B1

(12) United States Patent
Abdo

(10) Patent No.: US 6,248,047 B1
(45) Date of Patent: Jun. 19, 2001

(54) EXERCISE DEVICE

(76) Inventor: John S. Abdo, Box 363, Algonquin, IL (US) 60102

( * ) Notice: Subject to any disclaimer, the term of this patent is extended or adjusted under 35 U.S.C. 154(b) by 0 days.

(21) Appl. No.: 09/229,434

(22) Filed: Jan. 13, 1999

Related U.S. Application Data

(60) Provisional application No. 60/071,452, filed on Jan. 13, 1998.

(51) Int. Cl.[7] ..... A63B 21/04

(52) U.S. Cl. ..... 482/130; 482/142; 482/121

(58) Field of Search ..... 482/130, 121, 482/142, 123, 129, 907

(56) References Cited

U.S. PATENT DOCUMENTS

| | | | | |
|---|---|---|---|---|
| 3,802,701 | | 4/1974 | Good, Jr. . | |
| 3,947,025 | | 3/1976 | Hobby, Jr. . | |
| 4,170,351 | | 10/1979 | Ozbey et al. . | |
| 4,494,662 | | 1/1985 | Clymer . | |
| 4,517,966 | | 5/1985 | von Othegraven . | |
| 4,603,858 | | 8/1986 | Reehil . | |
| 4,687,197 | | 8/1987 | Larsson et al. . | |
| 4,720,100 | | 1/1988 | Du Buy . | |
| 5,052,684 | | 10/1991 | Kousge et al. . | |
| 5,094,450 | * | 3/1992 | Stearn | 482/130 |
| 5,154,685 | | 10/1992 | Chen . | |
| 5,215,511 | * | 6/1993 | Cheng | 482/121 |
| 5,232,425 | | 8/1993 | Miller et al. . | |
| 5,269,737 | | 12/1993 | Sobotka . | |
| 5,334,122 | | 8/1994 | Cole et al. . | |
| 5,352,171 | * | 10/1994 | Lin | 482/96 |
| 5,364,326 | * | 11/1994 | Smith et al. | 482/113 |
| 5,449,335 | | 9/1995 | Steinfeld . | |
| 5,456,657 | | 10/1995 | Cheng . | |
| 5,470,297 | | 11/1995 | Park . | |
| 5,522,783 | | 6/1996 | Gordon . | |
| 5,599,261 | * | 2/1997 | Easley et al. | 482/130 |
| 5,624,361 | * | 4/1997 | Lai | 482/130 |
| 5,730,688 | * | 3/1998 | Prusick | 482/130 |
| 5,759,138 | | 6/1998 | Boland . | |

* cited by examiner

*Primary Examiner*—Jerome Donnelly
(74) *Attorney, Agent, or Firm*—Law Office of Leon I . Edelson; Leon I. Edelson

(57) ABSTRACT

An exercise device is disclosed for use in exercising and strengthening abdominal and lower back muscles. The device is easily utilized, can be disassembled and is portable. The device utilizes an elongated resilient spring member, which can be interchanged for varying degrees for resistance. The elongated resilient spring member is demountably affixed to the seat portion of the device. The upper portion of the elongated resilient spring member features has an attached roller pad as an upper body support on one side and a handrail element on the other side. The handrail element is mounted by an adjustable clamp that grips the cross section of the handrail to vary the frictional resistance against the raising and lowering of the handrail. The rotatable hand grips of the handrail are mounted with lock pins for adjustment by the user. The user can sit on the seat element and exert backward, sideways, forward, and rotational pressure against the elongated resilient spring member with the hands grasping the grips so as to exercise the abdominal muscles and lower back muscles. A base stand is provided to assist a handicapped user in easy-on easy-off access by a swivel-mounting on the under side of he seat for circular rotation.

8 Claims, 3 Drawing Sheets

EXERCISE DEVICE

This application claims the benefits of Provisional Patent Application Ser. No. 60/071,452, filed Jan. 13, 1998.

BACKGROUND OF THE INVENTION

1. Field of Invention

The field of this invention relates to an exercise device for exercising all of the major muscles of the upper and lower abdomen, the internal and external obliques and rectus abdominus, the muscles of the spinal column including the erector spinal, and the intercostals, steratus anterior, latissmus dorsi, trapezium, fascia infraspinata, teres minor and teres major, without putting undue strain on the lumbar and the cervical spinal discs and the muscles comprising the lower back and hip flexors. The exercise device provides training of the frontal portion of the midsection, the abdominals, and isolating benefits to the obliques and the muscles of the spinal column.

Swaying, pivoting, rocking, bending forward, backward, sideways, and conditioning, circular, twisting, lateral bending, forward flexion, rearward extensions, and rotating motions of the upper body are basic movements of the human body. Movement of such nature against resistance has an effect upon the expansion and contraction of the affected muscles of the abdomen, of the spinal column and of the lower back to strengthen and tone all of the major muscles of the upper and lower abdomen, the obliques and major muscles of the spinal column.

The invented exercise device allows its user to exercise the entire midsection from one seated location, and from an anatomically correct upright posture. The entire midsection includes all of the muscles inside and surrounding the abdominals, obliques, and the muscles of the mid-to-lower back and of the spinal column. The invented exercise device acts to function as an extension of the torso, meaning whatever position the torso, or spine, can get into, the exercise device provides movement in all directions. These movements include but are not limited to lateral bending to both the right and the left, forward flexion, rearward extension, rotation and full circular motions both clock and counter-clock wise, and twisting motions to the right and left. The invented exercise device allows any combination of the aforementioned movements, and any intermediary movements that enable the midsection/torso to function in a 360 degree rotation.

2. Description of the Prior Art

Conventional approaches to the problem of training and strengthening the muscles of the human body utilize a means of providing resistance to body movements of the user. A problem can result in that resistance offered to movement of the human body and of specific muscles can lack any controlling means to prevent any unbalanced stress or strain that may induce injury by an uncontrolled movement. For example, Clymer, U.S. Pat. No. 4,494,662, teaches an exercise device which includes a spring mounted handle carried on a base which in turn can be carried on a support platform. The user can stand on the platform, which is mounted for back and forth rotary movement and is springbased to resist movement of the feet of user. Any movement of the spring mounted handles is opposed by the spring. Resistive forces are thereby transmitted back through the arms and body of the user to his legs and feet. Similarly, Reehil, U.S. Pat. No. 4,603,858, teaches an exercise device wherein the user grasps two handles and presses against a spring-loaded structural member which is belted to the user's mid-section and restrained from movement by two body contact pads, one at the chest, the other at the thighs of the user. Kosuge, U.S. Pat. No. 5,052,684 teaches an apparatus for training the waist portion of the human body wherein the user sits upon a rotatable table with his arms supported by a horizontal U-shaped arm support which pivots counter-clockwise to the clockwise movement of the rotatable table upon which the user sits. A restraining force against rotation of the table and the pivoting of the arm support is provided by a friction brake, the rotational force being supplied by the user. The user, by his twisting movement in a horizontal movement exercises his waist muscles in a limited range of motion. Miller, U.S. Pat. No. 5,232,425, teaches an exercise device for exercising the abdominal muscles wherein the user holds a rigid shaft between his legs, the shaft affixed to a horizontal handle for the hands of the user. Movement of the shaft within a shaft housing is restrained by elastic bands. The user exercises by pressing downward upon the shaft which is held between his legs and performing repetitions of "sit up" motions, thus exercising his abdominal muscles. Sobotka, U.S. Pat. No. 5,269,737, teaches an exercise device comprising a shoulder bar held upon the shoulders of the user, back of the neck, by the hands of the user. Elastic straps attached to the shoulder bar are anchored to a combined seat and seat bar which is held steady by the user's body weight. Resistance to body movement is provided by the elastic straps so as to exercise the oblique and waist muscles of the user as well as the muscles of the upper torso and mid-section of the user.

A disadvantage of the exercise device taught by Clymer '662, Reehil '858, Miller '425 and Sobotka '737 is that the user is not supported in the upper body and is not restrained in body movement so as to prevent undue stress being paced upon the muscles of the lower back and of the lumbar region. The user's body accordingly can be subjected to an unbalanced approach to training and strengthening the muscles of the abdomen and of the mid-to-lower spinal regions. Exercise devices taught by Clymer '662, Reehil; 858, Miller '425, and Sobotka '737 are functional for their intended purposes and illustrate the difficulty of achieving a balanced approach to exercising and strengthening the muscles of the abdomen and mid-section of the body of the user and yet prevent undue stress or strain upon the muscles of the lower back and lumbar region.

The exercise device taught by Kosuge '684 restricts the body movements of the user to pivoting motions of the upper body to the lower body in waist twisting movements. The waist twisting movements are restrained by a friction brake to provide resistance to the waist twisting movement. As the upper body is supported by arm supports, which encircle the user's body, the user's body movement is limited to a twisting movement consisting of turning the upper body in opposition to the lower body in an oscillatory sequence. Strengthening and training of the body muscles accordingly is limited to muscles of the waist portion of the human body without a balanced approach to exercising and strengthening the muscles of the abdomen and mid-section of the body of the user.

Accordingly, as can be observed from the description of the above prior art exercise devices, a balanced approach to the problem of exercising the mid-section of the body by use of an exercise device without causing undue stress or strain upon the muscles and vertebrae of the lower back or the thoracic and lumbar region has been hampered by availability of exercise devices which permit and promote a full range of body movements to strengthen and exercise the mid-section of the body. Additionally, exercise devices in the prior art are unrestricted to a limited number of movements by the physical requirements of the equipment. The movements are limited to backward and forward, or sideways or twisting.

The object of the present invention is a solution to the above problem, being a simple exercise device which permits the exercise and strengthening of the mid-section of the body but which protects and serves to reduce undue stress and strain upon the lower back and the lumbar region. It is a further object of this invention to provide a balanced approach to the problem of exercising the mid-section of the body wherein the user is positioned so as to naturally assume the necessary exercise position of being seated with arm support and the back muscles being properly supported during the exercise movements, yet, training and strengthening benefits are provided to the obliques and muscles of the spinal column. The user has a fill range of movement including movements backward, forward, twisting, bending forward, bending backward, twisting, turning, raising and lowering the arms with full freedom of movement.

SUMMARY OF THE INVENTION

The exercise device of this invention comprising a horizontal main frame containing an upright bracket, a seat cushion affixed to said horizontal main frame, an vertical elongated resilient spring member containing a lower bar with apertures or holes and an upper bar with apertures or holes, the lower and upper bar inserted within a coil spring to form said elongated resilient spring member, a means of affixing the lower bar of said elongated resilient spring member to said upright bracket of said horizontal main frame, a handrail terminating in rotatable hand grips, a means for affixing said handrail to said vertical elongated resilient spring member, a roller pad assembly and a means for affixing said roller pad assembly to said vertical elongated resilient spring member. The rotatable hand grips are mounted with lock pins for adjustment by the user. The user sits on the horizontal seat cushion mounted on the main frame and exercises against the resistance of the vertical elongated resilient spring member to exert backward, forward, sideways, and rotational pressure so as to exercise all the major muscles of the upper and lower abdomen and the muscles of the spinal column. A base stand is provided to assist a handicapped user in easy-on easy-off access by an optionally-used swivel mounting on the underside of the main frame which can be locked into fixed position by the user. The handrail is supported by the vertical elongated resilient spring member. The roller pad assembly is supported by the vertical elongated resilient spring member. The vertical elongated resilient spring member returns to its original upright vertical position upon removal of pressure by the user to a zero-neutral position. Starting at the zero-neutral position, once the user moves in any direction, whether backward, forward, sideways, twisting, bending, the elongated resilient spring member provides continuous, even, balanced and conforming resistance. The upright bracket on the horizontal main frame is positioned behind the rear of the seat so that the base of the pelvis/buttocks of the user is before the positioning of the vertical elongated resilient spring member which is affixed to the upright bracket on the horizontal main frame. The vertical elongated resilient spring member parallels the spine of the user from the base of the pelvis/buttocks and ends at about the height of the armpits and at the position of the roller pad assembly. The user, by sitting in position against the roller pad assembly, naturally assumes the correct position to minimize strain upon the muscles of the spinal column in conjunction with use of the handrail during exercise. The foam roller is positioned to enable the user to press against the tension of the elongated resilient spring member without the vertical elongated resilient spring member being in contact with the user's back and thus rubbing against the back during exercise. The positioning of the vertical elongated resilient spring member on the upright bracket of the horizontal main frame in back of the seat cushion provides necessary space against back contact.

DETAILED DESCRIPTION OF THE INVENTION

Figure 1:
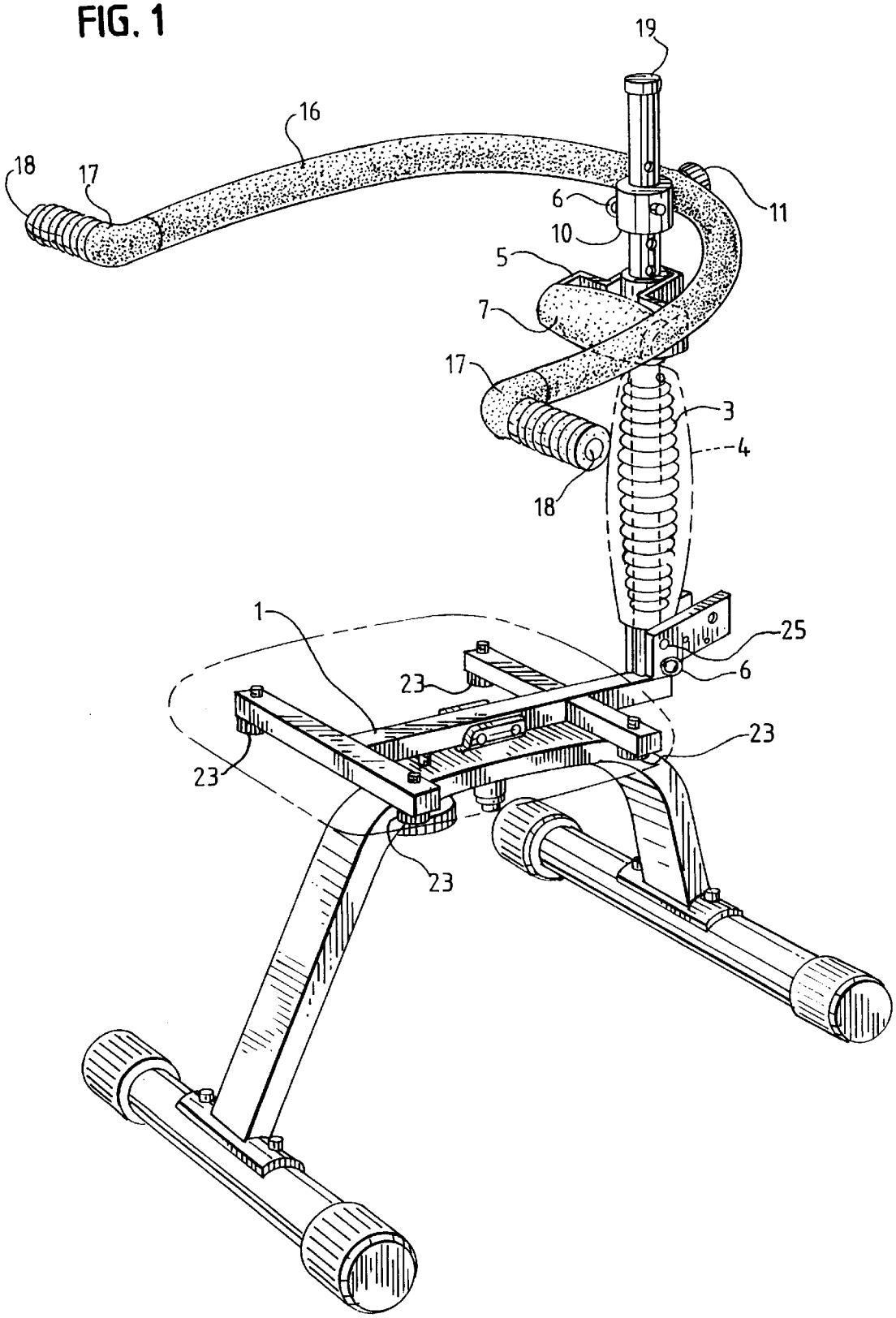
FIG. 1 is a perspective view of the exercise device of the present invention.

While the present invention is open to various modifications and alternative constructions, the embodiments shown in the drawings will be described here in detail. It is understood, however, there is no intention to limit the invention to the particular form described. On the contrary, it is intended that the invention cover all modifications, equivalences and alternative constructions falling within the spirit and scope of the appended claims.

The exercise device of this invention includes a base frame 1 upon which is mounted a seat cushion 2. The frame 1 includes an upright bracket upon which is mounted the elongated resilient spring member 3 by bolts 6 and 25 and nut 26. A foam pad encases the elongated resilient spring member 3. Bracket 5 supports foam roller 7 by foam sleeve 8 and foam shaft 9. Screws 22 on each side of bracket 5 are inserted into foam shaft 9 to maintain the foam roller 7 in place. Clip 10 on elongated resilient spring member 3 is an adjustable clamp that grips the cross section of the handle rail 13 wherein adjustment of the clip 10 is by locking knob 11, spacer 12, and bolt 24. Foam tubes 16 are inserted onto handrail 13 for the comfort of the user. Handlebars 14 are attached to handrail 13 by spring pins 15. Hand foam grips 17 are inserted onto the handlebars 14 to improve the user's grip on the handlebars 14. Plugs 8, 19, 20 and 21 plug the several openings of the device.

The exercise device is equipped with a base stand, which can be removed from the device. The base stand has means for attachment to and removal of the base stand from the underside of the main frame by a screw bolt with a knurled knob. The main frame has an aperture on the underside for the insertion of a swivel mount on the base stand to permit the user to swivel the exercise device upon the base stand.

The user has the option to remove the exercise device from the base stand. Without the use of the base stand, the exercise device is placed on top of a chair, a bench, a stair or any similar secure support. Removal of the base stand permits the unit to be easily portable. The pull pin 16 in the base of the vertical elongated resilient spring member can be pulled to fold the elongated resilient spring member flat against the seat cushion. The hand rail clip 10 can be loosened to fold the handrail flat.

The elongated resilient spring member is comprised of a shortened rounded rod which inserts into the upright bracket of the main frame, a tension coil spring which inserts over one end of a first shortened rounded rod and a second shortened rounded rod which is inserted in the upper end of the tension coil spring. The shortened rounded bars contain a number of apertures or holes vertically aligned from the lower and upper ends of the bars. Bolts are utilized, together with a pull pin, to be inserted through the holes in the lower bar to position the elongated resilient spring member in an upright position by means of he upright bracket in the main frame. Pull pins 6 are utilized to position the clip 10 for the handrail 13 and the foam brace 5 on the elongated resilient spring member. A foam pad is inserted over the elongated resilient spring member for the comfort of the user.

Figure 2:
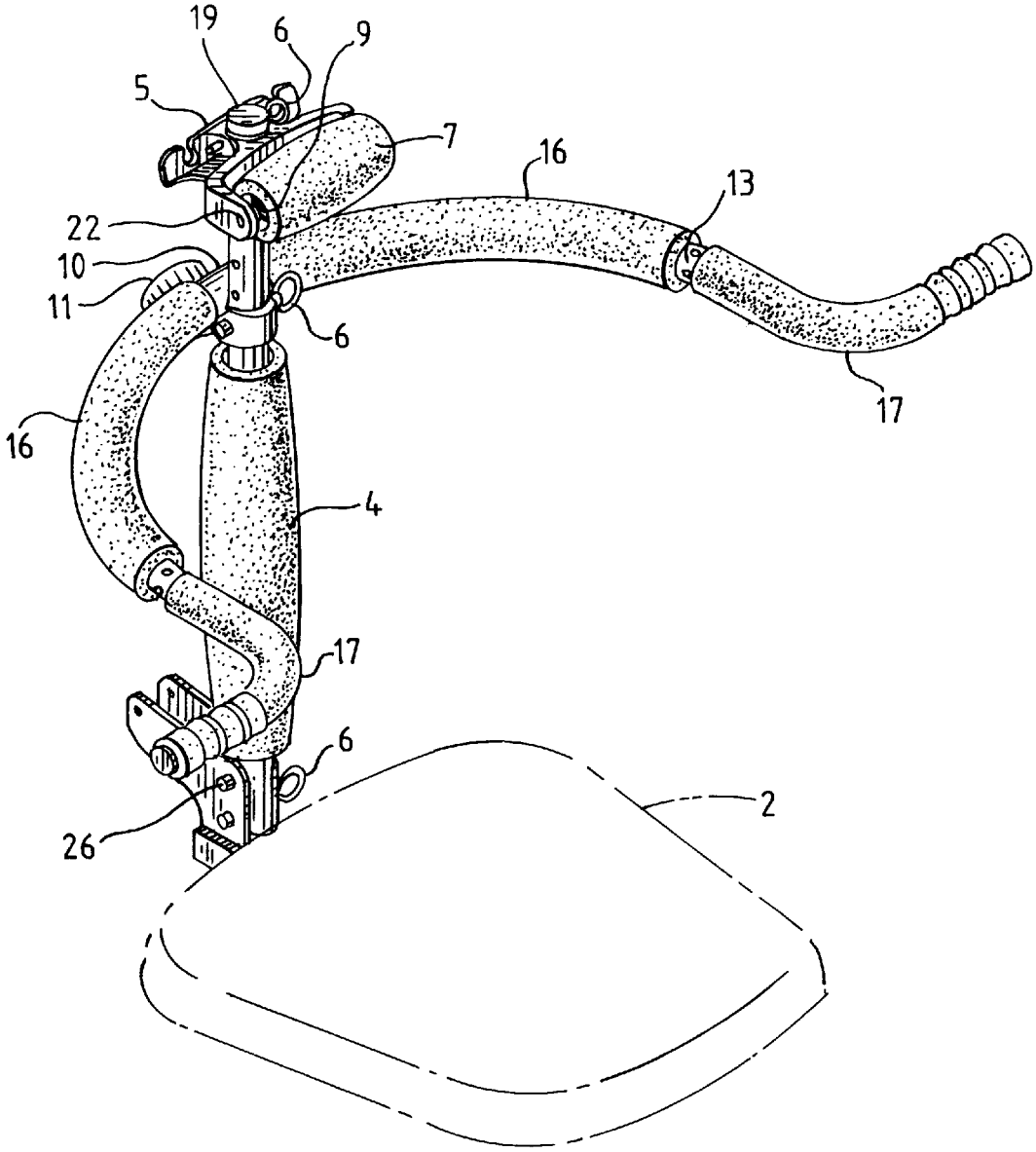
FIG. 2 is a perspective view of the exercise device with part names of the present invention.
Figure 3:
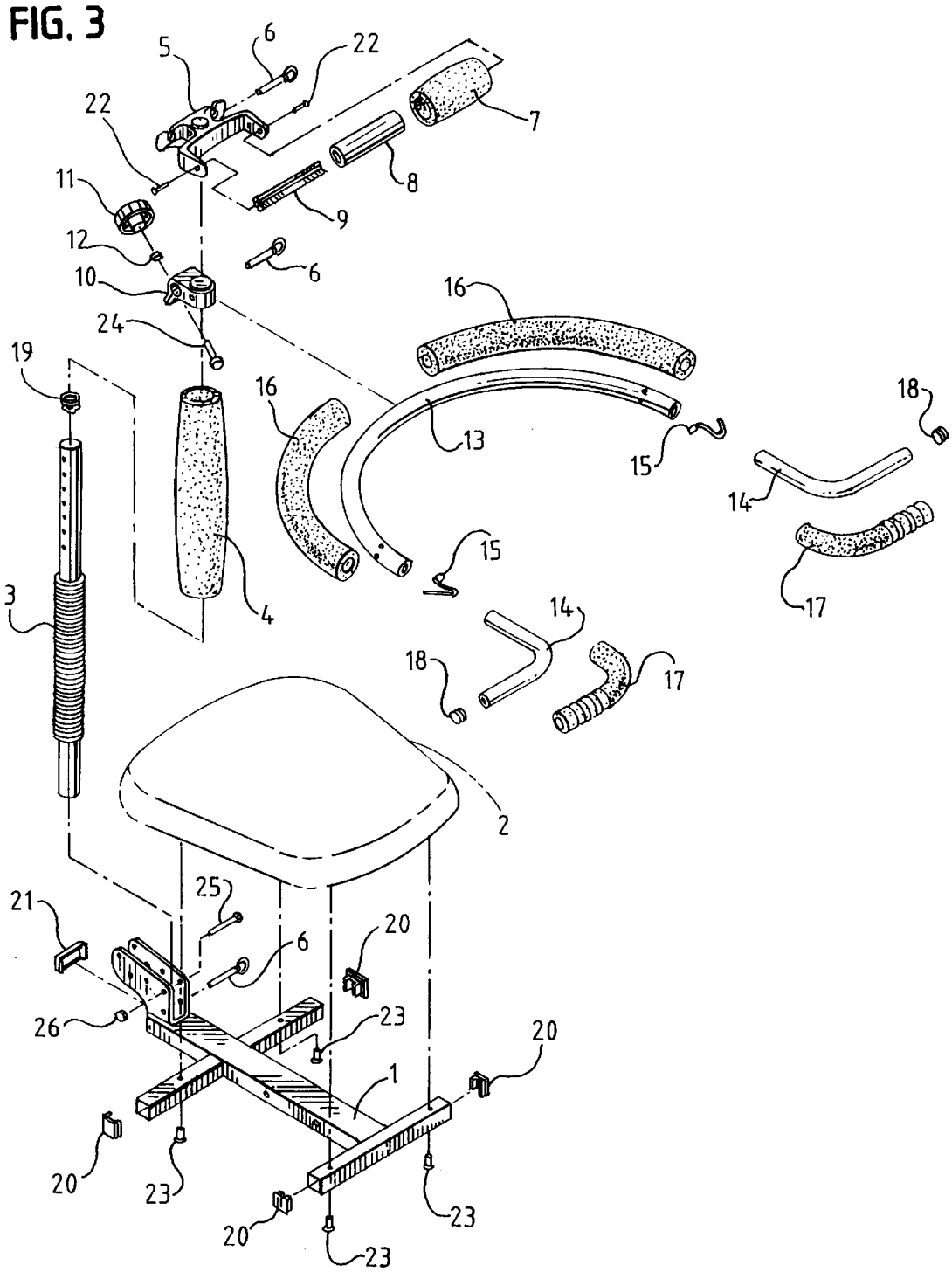
FIG. 3 is a perspective view of the parts of the exercise device of the present invention of FIG. 1.

The foam roller, see FIG. 2, is positioned by the user at about the height between the shoulder blades to enable the user to comfortably press the back against the tension of the vertical elongated resilient spring member in contact with the back and thus rubbing against the back during exercise. The foam roller provides a massage advantage to the user by massaging the muscles of the back and spine during exercise to stimulate blood circulation.

The handrail is adjustable up and down on the vertical elongated resilient spring member by removing the pull pin 6 from the clip 10 and moving clip 10 up and down to a position suitable for the user. Clip 10 is adjustable by use of locking knob 11 and bolt 24 which adjusts the frictional resistance and the raising and lowering of the handrail to above the armpits or below the armpits of the user. The handrail can be fixed in position or be allowed to move freely vertically, up-and-down according to the preference of the user.

Positioning of the handrail below the armpits of the user allows the user to support the arms and upper body fully. Positioning of the handrail above the armpits of the user and over the shoulders increases the leverage factor of the elongated resilient spring member against movements of the user, the added resistance factor being created by the extended arms leverage. By holding the handrail over the shoulders, the user can obtain a natural back/spinal arch.

The handrail terminates with foam grips on each end for the user's comfort, which are inserted on the left and right handlebars 14. The handlebars are held in place by spring pins 15 which permit rotation of the handlebar into four positions, outward, inward, upward, downward, which allow the user to modify his grip accordingly to his exercise movement.

In summary, the instant invented exercise device comprises a horizontal main frame having a rearward end and a forward end comprising a single elongated structural member with cross bars and an upright bracket mounted on the rearward end, a seat cushion having a rearward end and a forward end affixed to said horizontal main frame wherein position of said rearward end of said seat cushion is spaced apart from said upright bracket on said horizontal main frame, an elongated resilient spring member having a lower end and an upper end, extending generally upward from said upright bracket mounted on said horizontal main frame, a means for affixing said lower end of said elongated resilient spring member to said bracket on said horizontal main frame, a handrail affixed to upper end of said elongated resilient spring member, a means for affixing said upper end of said elongated resilient spring member to said handrail, a foam roller pad affixed to the upper end of said elongated resilient spring member, and a means for affixing said upper end of said elongated resilient spring member to said foam roller pad.

In further detail the exercise device of the instant invention features an elongated resilient spring member comprising a tension coil spring into which at each end is inserted a first and second shortened rounded bar, each bar containing a number of apertures vertically aligned from the end of each bar, the said handrail comprising an encircling hand support for grasping with the user's hands wherein said handrail extends from said elongated resilient spring member and encircles said user for said user to grasp with both hands, the said means for affixing said lower end of said elongated resilient spring member to said upright bracket on said horizontal main frame comprising said upright bracket of sufficient interior dimension to accept one end of said shortened rounded bar of said elongated resilient spring member in a male-female relationship and a pull pin inserted into an aperture of said upright bracket in alignment with an aperture in the end of said shortened rounded bar of said elongated resilient spring member, the said means for affixing said upper end of said elongated resilient spring member to said handrail comprising a clip of sufficient interior dimension to accept one end of said shortened rounded bar at upper end of said elongated resilient spring member in a male-female relationship and said shortened rounded bar at the upper end of said elongated resilient spring member is inserted into said clip, said clip having a second sufficient interior dimension to accept said hand rail in a male-female relationship and said handrail is inserted into said clip, the said means for affixing said upper end of said elongated resilient spring member to said foam roller pad comprising a foam brace of sufficient interior dimension to accept one end of said shortened rounded bar at upper end of said elongated resilient spring member in a male-female relationship and said upper end of said elongated resilient spring member is inserted into said bracket, said bracket containing an aperture in alignment with an aperture in end of said elongated resilient spring member wherein a pull pin affixes said bracket in place on said elongated resilient spring member, the said handrail is releasably locked in place on said elongated resilient spring member by a locking knob in conjunction with a compression bolt to exert friction pressure on said handrail, and rotatable hand grips are attached to said handrail by spring pins.

What is claimed is:

1. An exercise device comprising:

a horizontal main frame having a rearward end and a forward end comprising a single elongated structural member with cross bars and an upright bracket mounted on the rearward end, a seat cushion having a rearward end and a forward end affixed to said horizontal main frame wherein position of said rearward end of said seat cushion is spaced apart from said upright bracket on said horizontal main frame, an elongated resilient spring member having a lower end and an upper end, extending generally upward from said upright bracket mounted on said horizontal main frame, a means for affixing said lower end of said elongated resilient spring member to said bracket on said horizontal main frame, a handrail affixed to upper end of said elongated resilient spring member, a means for affixing said upper end of said elongated resilient spring member to said handrail, a foam roller pad affixed to the upper end of said elongated resilient spring member, and a means for affixing said upper end of said elongated resilient spring member to said foam roller pad.

2. The exercise device of claim 1 wherein said elongated resilient spring member comprises a tension coil spring into which at each end is inserted a first and second shortened rounded bar, each bar containing a number of apertures vertically aligned from the end of each bar.

3. The exercise device of claim 1 wherein said handrail comprises an encircling hand support for grasping with the user's hands wherein said handrail extends from said elongated resilient spring member and encircles said user for said user to grasp with both hands.

4. The exercise device of claim 1 wherein said means for affixing said lower end of said elongated resilient spring member to said upright bracket on said horizontal main frame comprises said upright bracket of sufficient interior dimension to accept one end of said shortened rounded bar of said elongated resilient spring member in a male-female relationship and a pull pin inserted into an aperture of said upright bracket in alignment with an aperture in the end of said shortened rounded bar of said elongated resilient spring member.

5. The exercise device of claim 1 wherein said means for affixing said upper end of said elongated resilient spring member to said handrail comprises a clip of sufficient interior dimension to accept one end of said shortened rounded bar at upper end of said elongated resilient spring member in a male-female relationship and said shortened rounded bar at the upper end of said elongated resilient spring member is inserted into said clip, said clip having a second sufficient interior dimension to accept said hand rail in a male-female relationship and said handrail is inserted into said clip.

6. The exercise device of claim 1 wherein said means for affixing said upper end of said elongated resilient spring member to said foam roller pad comprises a foam brace of sufficient interior dimension to accept one end of said shortened rounded bar at upper end of said elongated resilient spring member in a male-female relationship and said upper end of said elongated resilient spring member is inserted into said bracket, said bracket containing an aperture in alignment with an aperture in end of said elongated resilient spring member wherein an inserted pull pin affixes said bracket in place on said elongated resilient spring member.

7. The exercise device of claim 1 wherein said handrail is releasably locked in place on said elongated resilient spring member by a locking knob in conjunction with a compression bolt to exert friction pressure on said handrail.

8. The exercise device of claim 1 wherein rotatable handbars are attached to said handrail by spring pins.

* * * * *